US007422552B2

(12) United States Patent
Zepf

(10) Patent No.: US 7,422,552 B2
(45) **Date of Patent: *Sep. 9, 2008**

(54) CARTON FLAP GRIPPING SYSTEM

(75) Inventor: Peter Zepf, Langley (CA)

(73) Assignee: Wexxar Packaging, Inc., British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/611,362

(22) Filed: Dec. 15, 2006

(65) Prior Publication Data

US 2007/0161484 A1 Jul. 12, 2007

Related U.S. Application Data

(60) Provisional application No. 60/751,026, filed on Dec. 16, 2005.

(51) Int. Cl.
*B31B 1/78* (2006.01)

(52) U.S. Cl. ..... 493/309; 493/310; 493/312

(58) Field of Classification Search ..... 493/309, 493/183, 310, 311, 312, 318; 53/382.1, 381.1
See application file for complete search history.

(56) References Cited

U.S. PATENT DOCUMENTS

| | | | | |
|---|---|---|---|---|
| 3,220,159 | A | 11/1965 | Killeen | |
| 3,435,738 | A * | 4/1969 | Berney | 493/18 |
| 3,695,151 | A | 10/1972 | Caron | |
| 3,748,972 | A * | 7/1973 | Barton | 493/124 |
| 3,796,141 | A * | 3/1974 | Mueller | 493/312 |
| 4,348,853 | A | 9/1982 | Morse et al. | |
| 4,553,954 | A | 11/1985 | Sewell et al. | |
| 6,080,095 | A | 6/2000 | Chen | |
| 6,669,616 | B1 | 12/2003 | Bierenacki et al. | |
| 6,913,568 | B2 * | 7/2005 | Frank et al. | 493/309 |
| 7,131,941 | B2 * | 11/2006 | Makar et al. | 493/309 |
| 7,192,393 | B2 * | 3/2007 | Makar et al. | 493/309 |
| 2006/0100078 | A1 | 5/2006 | Makar et al. | |

* cited by examiner

*Primary Examiner*—Sameh H. Tawfik
(74) *Attorney, Agent, or Firm*—Thompson Hine LLP

(57) ABSTRACT

A carton flap gripping system including an adjustable pin holder is provided.

12 Claims, 5 Drawing Sheets

CARTON FLAP GRIPPING SYSTEM

CROSS REFERENCE TO RELATED APPLICATIONS

This application claims priority to U.S. Provisional application Ser. No. 60/751,026, filed Dec. 16, 2005.

TECHNICAL FIELD

This application relates generally to a flap gripper for a case erector and, more specifically, to an adjustable pin and block system for a pin type gripper.

BACKGROUND

Pin type grippers that employ a combination of pins and cooperating domes have been used successfully in case opening systems for corrugated boxes. Corrugated boxes are boxes are generally made from corrugated board composed of a pair of outer liners with a corrugated medium there between. The corrugated medium connects and holds the liners in substantially parallel spaced relationship. Pin type gripper systems rely on series of pins that are aligned with domes and that penetrate the open end of panels (flaps) on the corrugated box (i.e. between the liners) in a direction generally parallel to the longitudinal axis of the corrugations in the medium. The pins combine with their respective adjacent domes to grip the liner there between.

Attention is directed to U.S. Pat. No. 4,553,954 issued Nov. 19, 1985 Sewell et al. which shows a known pin and dome systems and applies it in known manner to grip adjacent panels of a corrugated box and then move them to squared position i.e. at right angles to each other to in effect open the case as part of the case erection process.

In the past, adjusting the grippers to accommodate different types/sizes of corrugated material from which the boxes may be made has been difficult. These adjustments are currently achieved in two different ways namely by adjusting the clearance between the pins and their respective adjacent domes or by adding or subtracting to change the total number of pins being employed.

Adjusting the clearance is obtained by removing the pin blocks which are formed with the longitudinal axis of the pins closed to one mounting surface than the opposite mounting surface and flipping the pin blocks and reattaching them so that the position (spacing) of the pins from the surface on which the pins and domes are mounted is changed. In the known systems this is a time consuming process in that it requires the use of tools to remove the pin blocks and requires time to ensure that when the blocks are reassembled in the apparatus they are correctly aligned Reducing the number of pins requires removal of the set screws that hold each individual pin to be removed in its mounting block and removing the pin. Increasing the number of pins requires positioning the additional pin(s) and inserting and tightening the clamping set screw to clamp the added pin in position. If a set screw was already in place it must at least be loosened the pin inserted and then tightened so that the set screw holds the new pin in place.

Even when the pins are properly inserted there are occasions where slippage is incurred which on occasion results in the case moving relative to the jaws during the squaring operation

SUMMARY

In one aspect, a gripping system for equipment for handling flaps formed by laminates having at least one surface ply is provided. The gripping system includes at least one pin stabilizer on a first side of an operating panel of the equipment, at least one passage through the pin stabilizer. A pin holder is mounted on the first side of the operating panel for movement between an operating position and a non-operating position relative to the pin stabilizer. A pin member extends from the pin holder such that the pin member has a free end, the pin member aligned with the passage of the pin stabilizer. In the operating position the pin member extends through the passage such that the free end of the pin member is exposed beyond the pin stabilizer. A latch assembly is located on the operating panel for releasably retaining the pin holder in both the operating position and the non-operating position. The latch assembly includes a projecting member biased into a latching position outward from the first side of the operating panel and a latch release exposed at a second, opposite side of the operating panel for moving the projecting member out of the latching position to permit movement of the pin holder.

In another aspect, a gripping system includes a mounting block on a first side of an operating panel of the equipment, at least one passage through the mounting block. A pin holder is mounted on the first side of the operating panel for movement between an operating position and a non-operating position relative to the mounting block. A pin member extends from the pin holder such that the pin member has a free end, the pin member aligned with and extending into the passage of the mounting block for movement therealong when the pin holder is moved. In the operating position the pin member extends through the passage such that the free end of the pin member is exposed beyond the mounting block. A lower side of the pin holder includes a downwardly projecting portion that is positioned below a top most portion of the mounting block when the pin holder is in the operating position.

BRIEF DESCRIPTION OF THE DRAWINGS

FIGS. 2 and 3 are views showing how pins operate to grip the panel of a box or the like;

DETAILED DESCRIPTION

Figure 1:
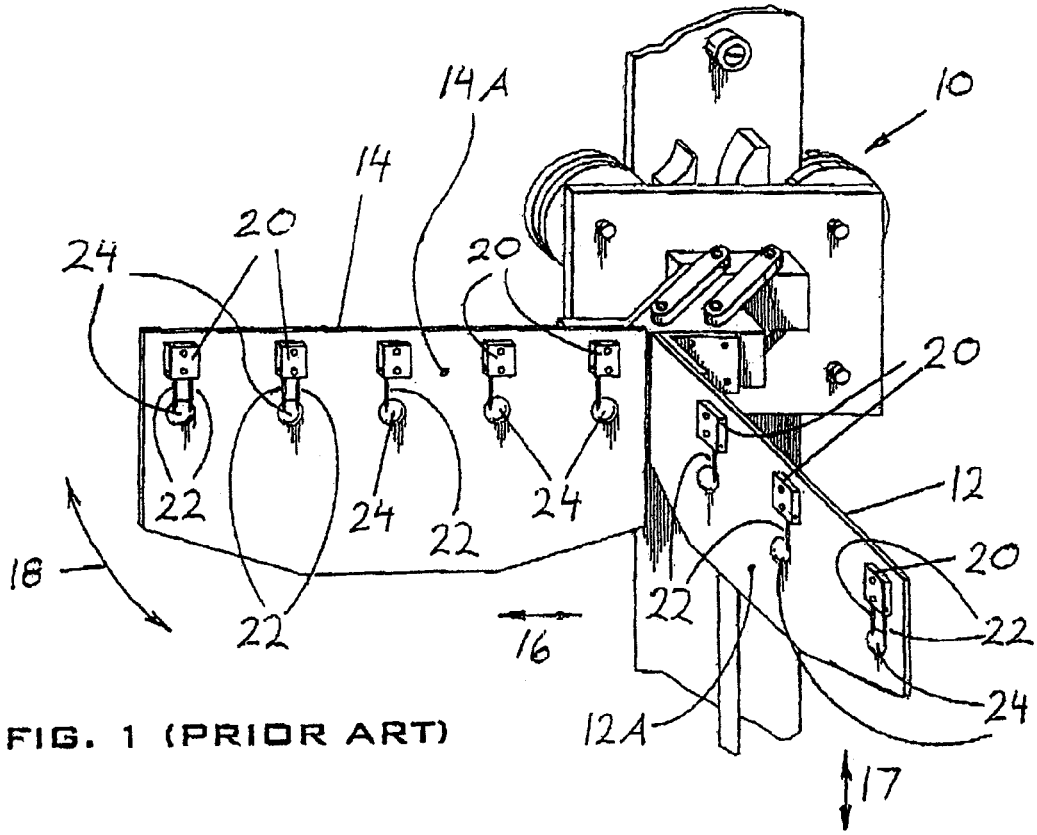
FIG. 1 (PRIOR ART)
FIG. 1 is an isometric view showing a prior art carton flap gripping system.

Referring to FIG. 1, the prior art device shown is described in full in U.S. Pat. No. 4,553,954. The device 10 comprises a pair of hinged operating panels or jaws 12 and 14 which as indicated by the arrow 16 are moveable from a receiving or pick-up position where they pick up a knocked down blank to an advanced position directly over a bottom flap folding station into which the squared blank is lowered as indicated by the arrow 17 to fold the bottom flaps. The jaw or operating panel 14 in this device is pivoted as indicated by the arrow 18 respective to the jaw 12 between the open squaring position shown in FIG. 1 and a spaced but substantially parallel receiving position wherein the jaw 14 is substantially parallel to the jaw 12.

Figure 2:
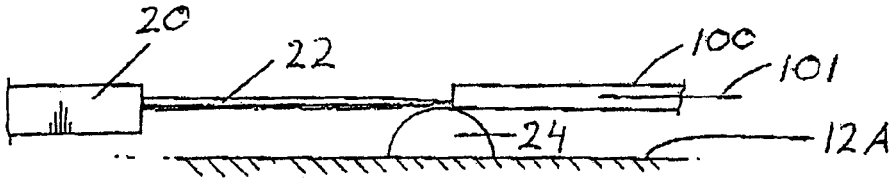
FIG. 2 (PRIOR ART)

The knocked down blanks 100 (only a portion shown—see FIGS. 2 and 3) formed of interconnected panels and flaps that are made of laminate (in the illustration are made form corrugated cardboard) composed of an outer layer 102 and an inner layer 104 generally called liners and an intermediate layer interconnecting the layers 102 and 104 that is generally in the form of a corrugated medium 105. When the jaws 12 and 14 are in the parallel receiving position (not shown) the blanks 100 are moved into a gripping position as indicated by the arrow 101 and gripped by the grippers 20 some of which are shown with a single gripping pin 22 and others with a pair of gripping pins 22 and one with no gripping pin see gripper 20A (see FIG. 1).

Figure 3:
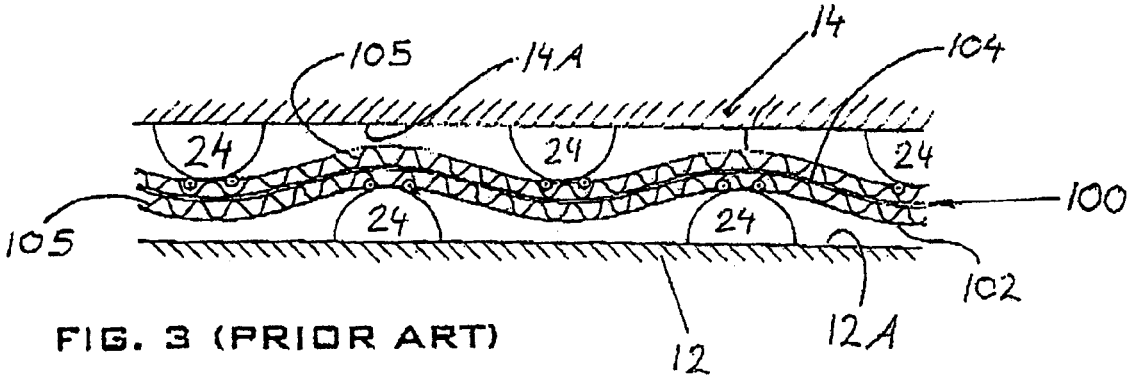
FIG. 3 (PRIOR ART)

Each gripper 20 is mounted on its jaw or operating panel 12 or 14 with its gripping pin(s) substantially parallel to the surface 12A or 14A of the operating panels 12 or 14 and are positioned to cooperate with dome shaped projections 24 extending from the surface 12A or 14A to grip the adjacent surface layer (i.e. the outer layer 102 on opposite sides of the blank 100 in FIG. 3) between the dome and its adjacent gripping pin to hold the flaps.

In operation as the blank 100 is moved as indicated by the arrow 101 and the pins 22 pass inside the panel immediately adjacent to the adjacent surface panel (outside layer 102) while the panels are being deformed by the domes 24 to an undulating shape in the illustration in FIG. 3 which facilitates entry of the pins 22. When the panels 12 and 14 are subsequently moved to the squaring position of FIG. 1, the box/blank is unfolded.

In order to change or reposition the pins 22 of a given gripper 20 each discrete pin must be removed from the gripper 20 and a new one mounted which required undoing the mounting screws taking out the pin inserting a new one and the tightening he screws which was very time consuming and tedious work reducing the output of the equipment.

Figure 4:
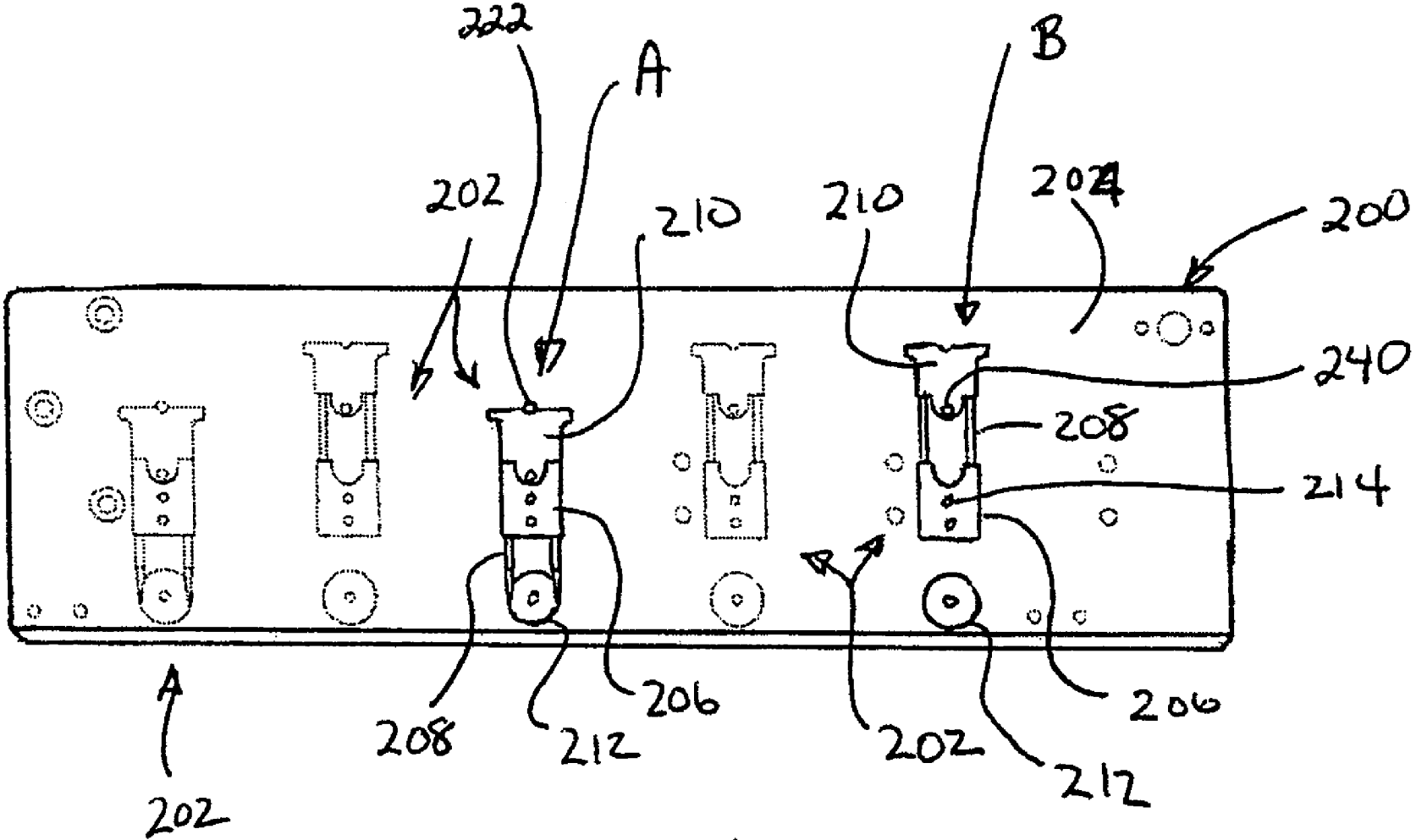
FIG. 4 is a front elevation view of one operating panel of a machine incorporating one embodiment of an adjustable carton flap gripping system.

Referring now to FIG. 4, one embodiment of an adaptable carton flap gripping system is shown with respect to one operating panel 200 of a machine that could function similar to the device 10 of FIG. 1. A plurality of gripping assemblies 202 are mounted in a spaced apart manner along the length of the panel at one side or surface 204. Each gripping assembly includes a pin stabilizer in the form of a mounting block 206. Other pin stabilizer constructions could be used, such as more simple ring-shaped brackets. The mounting block includes a pair of spaced apart passages therethrough (oriented vertically) for receiving spaced apart pins 208 that extend from a pin holder 210. Dome shaped members 212 are located below the mounting blocks 206.

As reflected in FIG. 4, the pin holders 210 are mounted for movement between an operating position (as shown at location A) and a non-operating position (as shown at location B) relative to the mounting block 206. The pin members 208 have free ends that can pass below the lower end of the mounting block, and adjacent the dome projections 212, when the pin holder is in the operating position. In the illustrated embodiment, the pins 208 have generally pointed ends that are retracted into the mounting blocks 206 when the pin holder 210 is in the non-operating position. However, it may be preferred that when in such position at least a portion of the larger diameter part of the pin also be positioned within the mounting block so as to limit back and forth movement of the pins (e.g., due to the outer surface of the pin being in contact with or closely adjacent to the inner surface of the passage through the mounting block 206.

Figure 5:
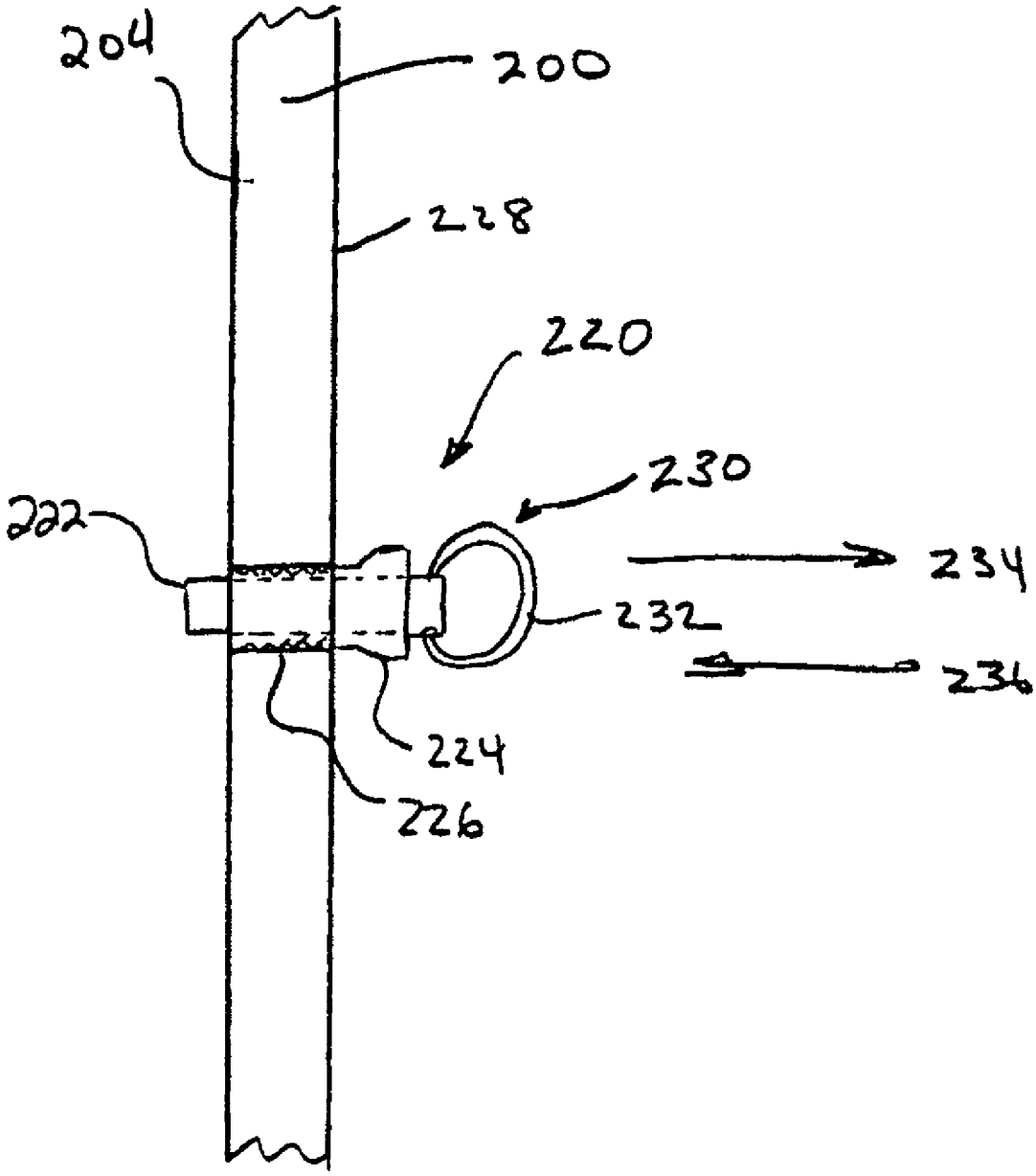
FIG. 5 is a side partial elevation depicting one embodiment of a latch assembly for use in connection with an adjustable carton flap gripping system.

The mounting blocks 206 may be mounted in a stationary manner to the panel 200 via one or more fasteners passing through openings 214 of the mounting block, which openings 214 align with corresponding openings in the panel 200. In order to retain the pin holder in either its operating or non-operating position, a respective latch assembly may be provided for each pin holder. In one example, referring now to FIG. 5, the latch assembly 220 includes a projecting member 222 (e.g., one end of a pin) that extends outward from side 204 of the panel into the latching position shown. A stationary body portion 224 of the latch assembly is threaded into an opening 226 in the panel 200 from an opposite side 228 of the panel. A latch release 230 is provided on side 228 of the panel. The latch release is, in the illustrated arrangement, formed by the opposite end of the pin and an attached ring-shaped grip 232. The pin is spring-loaded into the body portion 224 so as to be biased into the latching position shown. A user can grasp the grip 232 and pull the pin to move the projecting member 222 toward into a non-latching position (e.g., the projecting member moves in the direction of arrow 234 toward and into the panel). When the grip 232 is released, the bias moves the pin back in the direction of arrow 236 so that the projecting end 222 moves back to the latching position.

Referring back to FIG. 4, when the pin holder 210 is in the down, operating position shown at location A, the projecting member 222 is positioned above the top of the pin holder to hold the pin holder against upward movement. When the pin holder 210 is in the up, non-operating position of location B, the projecting member extends into an opening 240 of the pin holder.

Referring now to FIGS. 6-10, the mounting block 206 includes a recessed portion 250 located on its top side 252 toward the pin holder. The pin holder 210 includes a corresponding projection 254 on its lower side toward the mounting block, the corresponding projection 254 (located between the pins 208) shaped to fit within the recessed portion 250 of the mounting block when the pin holder is in the operating position (location A of FIG. 4). In the illustrated embodiment the recessed portion 250 and projection 254 have half-round shapes or generally U-shaped. The downwardly projecting portion 254 is therefore positioned below a top most portion of the mounting block 206 when the pin holder is in the operating position. In the illustrated embodiment the pin holder 210 is primarily rectangular in configuration with laterally extending shoulders 290 that facilitate gripping of the pin holder.

Figure 6:
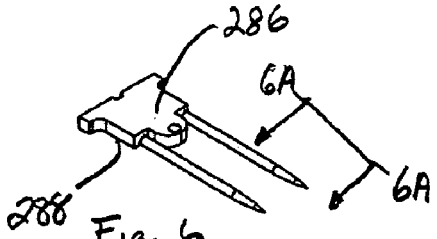
FIGS. 6 and 7 depict one embodiment of a pin holder.
Figure 6A:
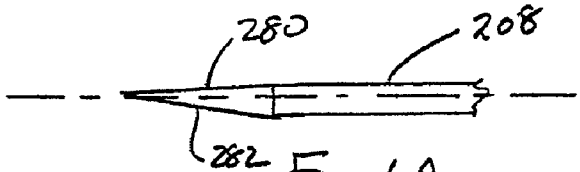
Figure 7A:
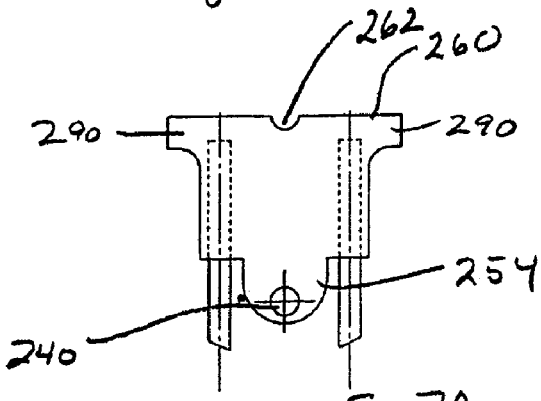
Figure 7:
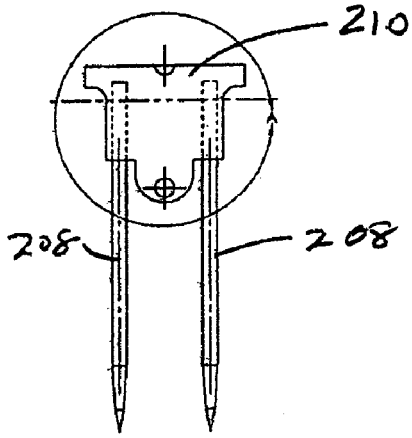

In one configuration, the free ends of the pins 208 are pointed and the points are formed by surfaces 280 and 282 that intersect an axis 284 of the pin 208 at different angles as seen in FIG. 6. The opening 240 in the pin holder 210 may be a through opening. With this combination, the pin holder can alternatively be positioned with either of its surfaces 286 or 288 adjacent the panel enabling the distance between the ends of the pins and the dome projection to be varied (due to the different angles of surfaces 280 and 282).

Figure 9:
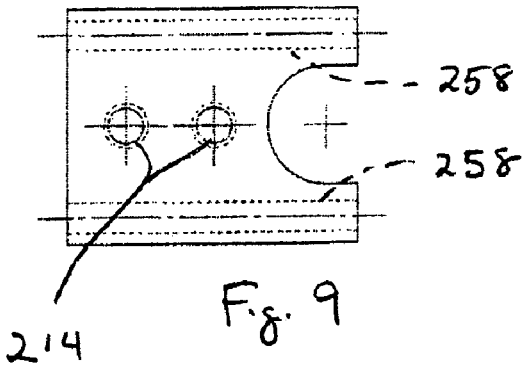
FIGS. 8-10 depict one embodiment of a pin stabilizer in the form of a mounting block.
Figure 10:
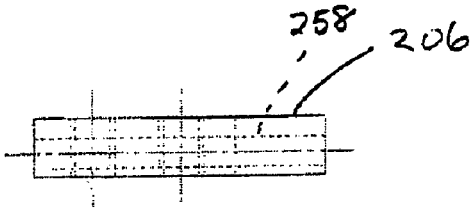
Figure 8:
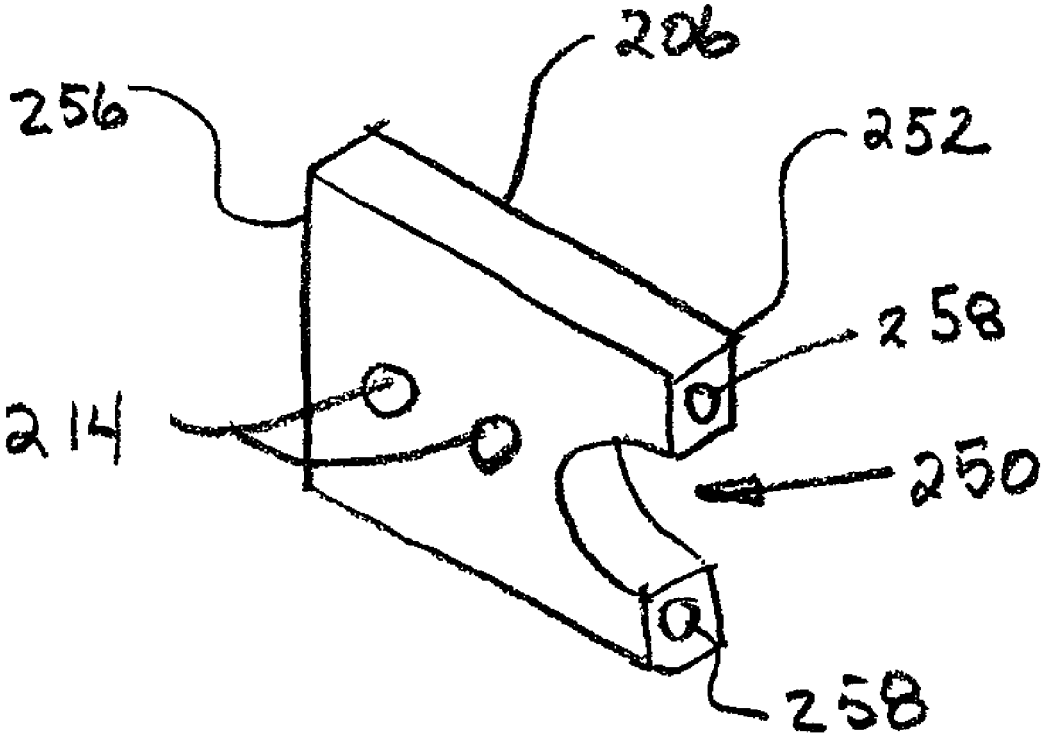

The spaced apart pin-receiving passages 258, extending from top side 252 to bottom side 256 of the mounting block 206 are best seen in FIGS. 8-10. The recess 250 is located between the passages 258.

The top side 260 of the pin holder 210 includes a half-round recess 262 that receives the projecting end 222 of the latch assembly pin when the pin holder is in the non-operating position (location B of FIG. 4).

The described flap gripping system enables simple and convenient adjustment of which pins are down and operative as is often necessary when setting up a case former for a new size box.

It is to be clearly understood that the above description is intended by way of illustration and example only, is not intended to be taken by way of limitation, and that other changes and modifications are possible.

What is claimed is:

1. A gripping system for equipment for handling flaps formed by laminates having at least one surface ply, the gripping system comprising:

at least one pin stabilizer on a first side of an operating panel of the equipment, at least one passage through the pin stabilizer;

a pin holder mounted on the first side of the operating panel for movement between an operating position and a non-operating position relative to the pin stabilizer, a pin member extends from the pin holder such that the pin member has a free end, the pin member aligned with the passage of the pin stabilizer, in the operating position the pin member extends through the passage such that the free end of the pin member is exposed beyond the pin stabilizer;

a latch assembly on the panel for releasably retaining the pin holder in both the operating position and the non-operating position, the latch assembly comprising a projecting member biased into a latching position outward from the first side of the operating panel and a latch release exposed at a second, opposite side of the operating panel for moving the projecting member out of the latching position to permit movement of the pin holder.

2. The gripping system of claim 1 wherein the at least one pin stabilizer is in the form of a mounting block having first and second spaced apart passages, first and second spaced apart pins of substantially the same length and with respective free ends extend from the pin holder, the first pin extends into the first passage the second pin extends into the second passage.

3. The gripping system of claim 2 wherein the mounting block includes a recessed portion located on a side toward the pin holder, the pin holder includes a corresponding projection on a first side that is toward the mounting block, the corresponding projection shaped to fit within the recessed portion of the mounting block when the pin holder is in the operating position.

4. The gripping system of claim 3 wherein the recessed portion is substantially U-shaped and the corresponding projecting portion is substantially U-shaped.

5. The gripping system of claim 3 wherein the corresponding projecting portion includes an opening at its panel facing side for receiving the projecting member of the latch assembly when the pin holder is in the non-operating position.

6. The gripping system of claim 5 wherein the first side is a lower side of the pin holder, the pin holder includes an opening at its top side for receiving the projecting member of the latch assembly when the pin holder is in the operating position.

7. The gripping system of claim 6 wherein the opening at the top side of the pin holder is a half-round configuration.

8. The gripping system of claim 1, further comprising:

a dome located on the first side of the operating panel and located such that the free end of the pin member is positioned proximate a surface of the dome when the pin holder is in the operating position.

9. The gripping system of claim 1 wherein the latch assembly is a spring-biased pin unit, the projecting member comprises one end of a pin, the pin holder includes an opening for receiving the end of the pin when the pin holder is in the operating position.

10. A case erector machine incorporating the gripping system of claim 1, the operating panel comprises a first operating panel of the case erector machine, the case erector machine further comprises a second operating panel, the first operating panel movable between a position substantially parallel to the second operating panel and a position substantially perpendicular to the second operating panel.

11. The case erector machine of claim 10 wherein both the first and second operating panels are movable up and down on the machine during a case erecting process of the case erector machine.

12. The case erector machine of claim 10 wherein the first and second operating panels are located proximate to and downstream of a folded case storage and loading zone of the case erector machine.

* * * * *